US007284876B2

(12) United States Patent
Ericson

(10) Patent No.: US 7,284,876 B2
(45) Date of Patent: Oct. 23, 2007

(54) DISPLAY SYSTEM FOR GAMING CABINETS

(75) Inventor: Greg Ericson, Memphis, TN (US)

(73) Assignee: Ericson Group, Inc., Memphis, TN (US)

( * ) Notice: Subject to any disclaimer, the term of this patent is extended or adjusted under 35 U.S.C. 154(b) by 20 days.

(21) Appl. No.: 11/241,361

(22) Filed: Sep. 30, 2005

(65) Prior Publication Data

US 2007/0076405 A1 Apr. 5, 2007

(51) Int. Cl.
*A47F 11/10* (2006.01)

(52) U.S. Cl. ..... 362/125; 362/30; 312/223.5; 40/564

(58) Field of Classification Search ..... 362/97, 362/125, 30; 40/564; 312/223.5
See application file for complete search history.

(56) References Cited

U.S. PATENT DOCUMENTS 5,373,428 A 12/1994 Day
5,584,547 A * 12/1996 Trulaske, Sr. ..... 312/223.5
5,943,801 A * 8/1999 Wilkinson ..... 40/564
6,578,301 B1 6/2003 Ericson
2005/0168974 A1 8/2005 Wiesberg et al.

* cited by examiner

*Primary Examiner*—Sandra O'Shea
*Assistant Examiner*—James W Cranson, Jr.
(74) *Attorney, Agent, or Firm*—Maginot, Moore & Beck

(57) ABSTRACT

There is provided a display system for gaming cabinets comprising a backlit display and a mounting plate. The backlit display comprises a lighting source, an arcuate translucent face sheet, and a support frame for supporting said lighting source and said face sheet, said support frame comprising a hinged top cover, a base member, and an opposing pair of side clamp frame assemblies. The side clamp frame assemblies each retain a side edge of the arcuate face sheet. The mounting plate comprises a back panel for fixing to the back side of said backlit display and a base plate including a plurality of anchor holes for securing the display system to a cabinet.

7 Claims, 4 Drawing Sheets

DISPLAY SYSTEM FOR GAMING CABINETS

TECHNICAL FIELD

The present disclosure relates generally to visual display devices, and more specifically, concerns a visual display system for the end of a row of gaming or vending machines.

BACKGROUND

Backlit displays have been widely taught in the art for use in commercial settings and are routinely used for promotional purposes in retail settings. The typical backlit display device projects light from an enclosed light source out through a graphic display media towards the viewer, thereby enhancing the visual effect (especially in low light situations) during evening hours.

Backlit displays are widely used in promotion and sale of products. Backlit displays provide a particularly effective marketing tool. The backlit display apparatus typically includes a housing with a flat front display panel. Suitable illuminating devices such as fluorescent lamps or other like elements are secured to project light through the front display panel and thereby drawing attention to the subject matter carried by the display panel. One such apparatus includes a relatively shallow back support structure to which lamps or the like are secured. Sidewalls project forwardly with a transparent panel closing the front of the sign. A display sheet is interposed or secured to the front side of the panel and is constructed to permit illumination of the display member as a result of the light.

However, flat faced displays are not desirable for wide open areas where people can see the display from many different angles or in situations where people may not be able to look directly at the display. For instance, a backlit display can be used at the end of a bank of gaming or vending machines. To compensate, backlit displays have been designed with curved or arcuate face sheets.

There is a need for arcuate display assemblies or apparatus, which can be easily associated with or removed from association with the end of a bank of machines such as gaming or vending machines or the like without the need of complicated or time consuming and expensive procedures. There is a need to be able to quickly and easily change or replace the display material such as graphics in the backlit display, for example when new advertising material is being changed or updated. Moreover, it is necessary to be able to quickly access and service the internal components of the backlit display.

SUMMARY

In response to the needs left unmet by these prior systems, there is provided a display system for gaming cabinets comprising a backlit display and a mounting plate. The backlit display comprises a lighting source, an arcuate translucent face sheet, and a support frame for supporting said lighting source and said face sheet, said support frame comprising a hinged top cover, a base member, and an opposing pair of side clamp frame assemblies. The side clamp frame assemblies each retain a side edge of the arcuate face sheet. The mounting plate comprises a back panel for fixing to the back side of said backlit display and a base plate including a plurality of anchor holes for securing the display system to a cabinet.

The display system described is easily mountable to the end of a bank of gaming or vending machines. All that is needed is a few inches of space at the end of the cabinet. The side clamp frame assemblies in conjunction with the hinged top cover provide quick and easy access for graphic loading and unloading as well as easy access for servicing the internal components of the backlit display.

An alternative embodiment of the display system for gaming cabinets comprises a mounting plate including a rearward projecting plate with an upward projecting rib extending down the center of the rearward projecting plate. In this embodiment, the rearward projecting plate is designed to be slid under the bases of two back to back gaming or vending machines that are on the end of a bank of machines. When in position, the upward projecting rib extends between the backs of the two machines. This embodiment is beneficial when there is not enough room at the end of a cabinet base to mount the display system using the anchor holes.

These and other benefits and advantages of the invention will be readily discerned from the following written description, taken together with the accompanying figures.

BRIEF DESCRIPTION OF THE DRAWINGS

Aspects and features of the present embodiments will become apparent as the following description proceeds and upon reference to the drawings, in which.

DESCRIPTION

Figure 1:
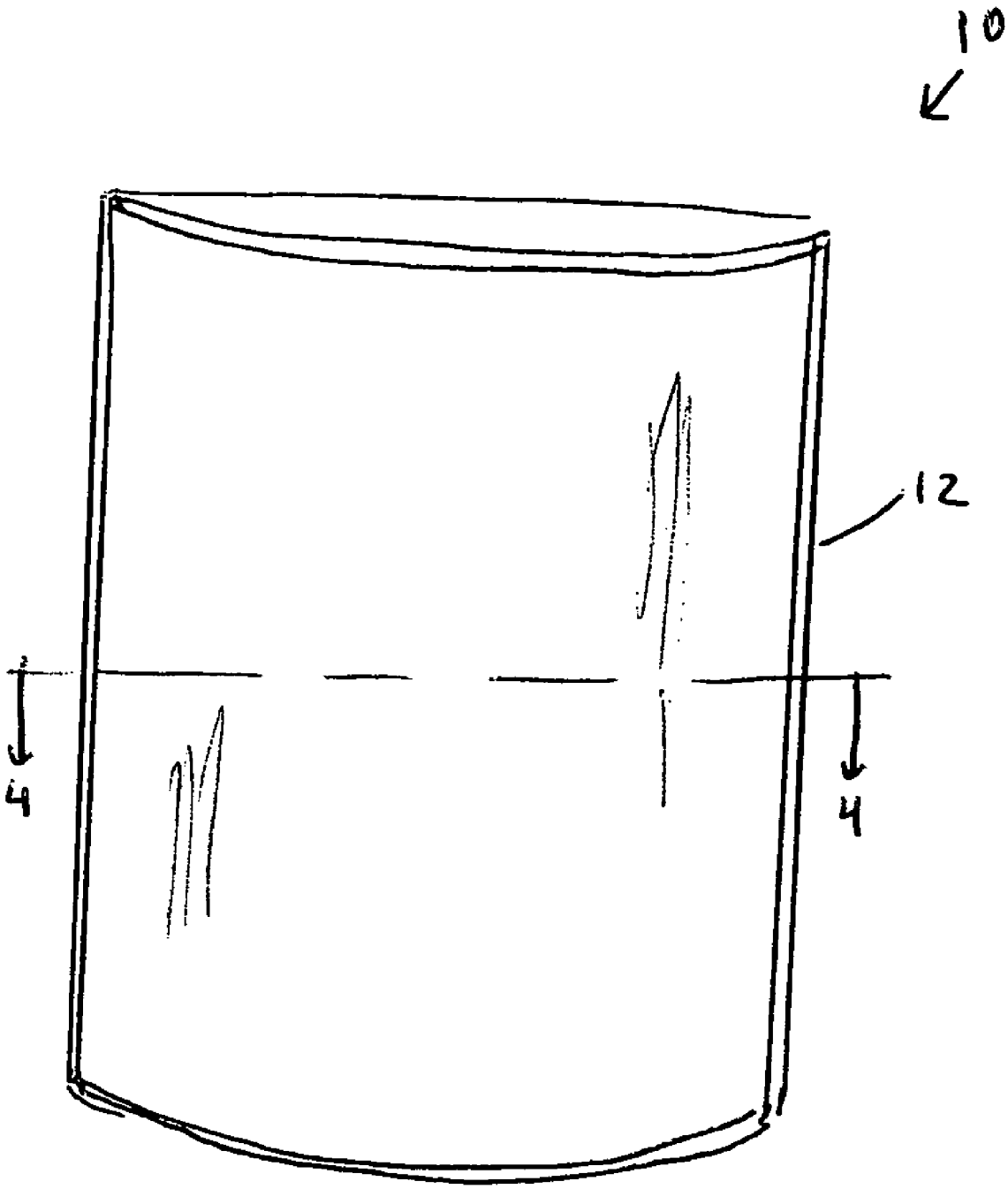
FIG. 1 is a perspective view of a display system for gaming cabinets of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Referring now to FIG. 1, there is shown an exemplary embodiment of a display system for gaming cabinets, generally designated 10. The display system 10 includes an arced backlit display 12 and a mounting plate 14 (not shown).

Figure 2:
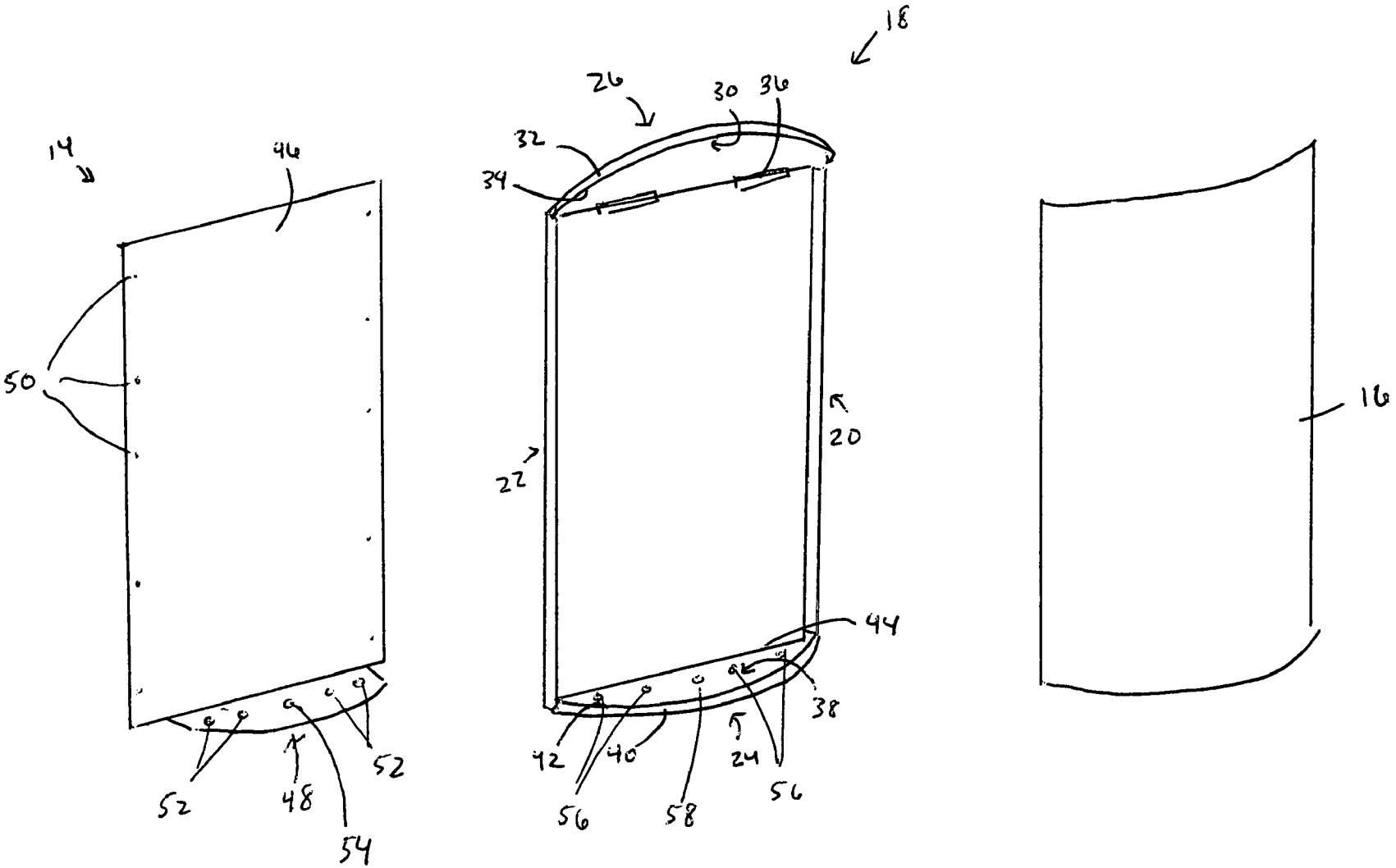
FIG. 2 an exploded elevational view of the display system of FIG. 1.

Referring not to FIG. 2, the arced backlit display 12 includes an arcuate face sheet 16 of translucent plastic material, such as acrylic or polycarbonate, and a support frame, generally indicated by numeral 18, by which the face sheet 16 is held in place. The support frame 18 is essentially rectangular in shape and includes opposing side clamp frame assemblies 20, 22, a base member 24, and a hinged top cover 26. The back lighting is provided by two fluorescent bulbs (not shown) extending substantially between the top cover 26 and base member 24 of the frame and attached by brackets (not shown). It can be appreciated that, while two lamps are shown by way of example, the lamps can be provided in a sufficient number and at appropriate spacings to ensure even illumination.

Figure 3:
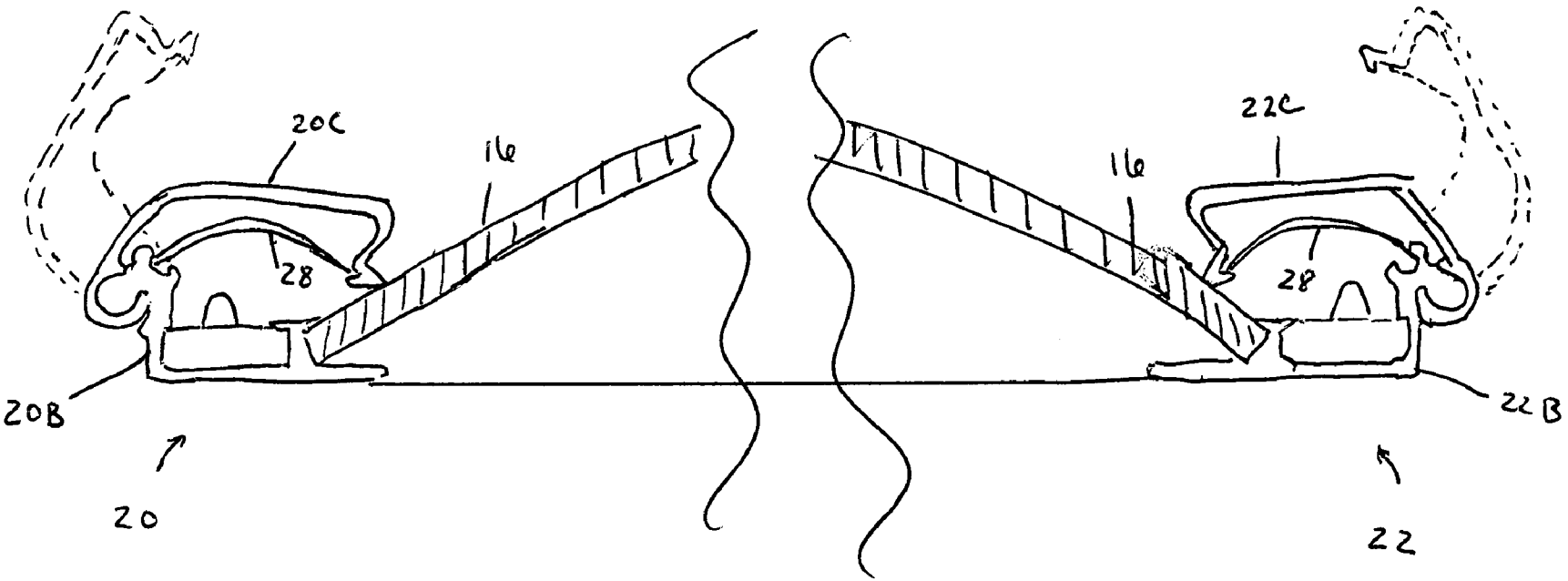
FIG. 3 is sectional view taken along line 4-4 of FIG. 1.

Referring now to FIG. 3, the clamp frame assemblies 20, 22 are formed of conventional extruded metal such as aluminum. Each clamp frame assembly 20, 22 has a base member 20B, 22B which receives and retains a side edge of the face sheet 16. The base members 20B, 22B pivotally support sheet clamps 20C, 22C. Each of the sheet clamp components 20B, 22B, 20C, 22C is biased by an over-center spring 28 into either a clamping position shown in solid lines or an open position shown in dashed lines in FIG. 3. Each spring 28 urges its respective sheet clamp 20C, 22C to either position when manually moved past an over-center position. The foregoing clamp frame components are indicated by the manufacturer as being covered by one or more of U.S. Pat. Nos. 4,145,828; 4,512,095; 4,519,152; 4,523,400; 4,714,220; 4,937,959 and 4,958,458.

As shown in FIG. 2, the top cap assembly 26 includes a planar member 30 having an arcuate front edge 32 with a downward projecting flange and 34 a hinged back edge 36 attached at both ends to the opposing snap frame assemblies 20, 22. The top cap assembly 26 is sized and shaped so the downward projecting flange 34 of the front edge 32 is outside of the face sheet 16 and snap frame assemblies when they are in the closed position. The hinged back edge 36 allows the top cap assembly 26 to be rotated upward and in conjunction with opened clamp frame assemblies 20, 22 allows easy access for loading and unloading of graphics.

The base member 24 includes a planar member 38 having an arcuate front edge 40 with an upward projecting flange 42 and a back edge 44 fixed at both ends to the opposing side clamp frame assemblies 20, 22. The base member 24 is sized and shaped so the upward projecting flange 42 is outside of the face sheet 16 and inside of the snap frame assemblies 20, 22 when they are in the closed position so as not to interfere with the clamping motion of the clamp frame assemblies 20, 22.

Referring again to FIG. 2, there is shown the mounting plate 14. The mounting plate 14 acts to reinforce the back and base of the backlit display 12 and provide a sturdy means of mounting the display system 10. In that regard, the mounting plate 14 is preferably formed of a sturdy metal such as 18 ga. steel although other materials suitable for reinforcing and mounting are contemplated. The mounting plate 14 is comprised of an integrally formed back panel 46 and base plate 48. The base plate 48 projects from the bottom of the back panel 46 at approximately a 90° angle. The back panel 46 is generally rectangular in shape and is approximately the same size as the support frame 18 of the backlit display 12. The back panel 46 is secured to the backside of the support frame with the base plate 48 extending underneath the base member 24 of the support frame 18. A plurality of holes 50 formed along the edges of the back panel 46 corresponds to a plurality of openings located on the back edges of the snap frame assemblies (not shown). The holes 50 and openings allow for fastening devices, such as carriage nuts and bolts, screws or bolts (not shown), to secure the backlit display 12 to the mounting plate 14.

In one embodiment of the display system 10, the base plate 48 portion of the mounting plate 14 is formed with a plurality of anchor holes 52 and a power access hole 54 that correspond to anchor holes 56 and a power access hole 58 that are formed in the base member 24 of the support frame 18. The power access holes 54, 58 allow a power cord from the backlit display 12 to be fed through the support frame 18 and mounting plate 14. The anchor holes 52, 56 are for anchoring through the base of the display system 10 to a cabinet such as is used for a bank of gaming or vending machines or other surface as shown in FIG. 1.

Figure 4:
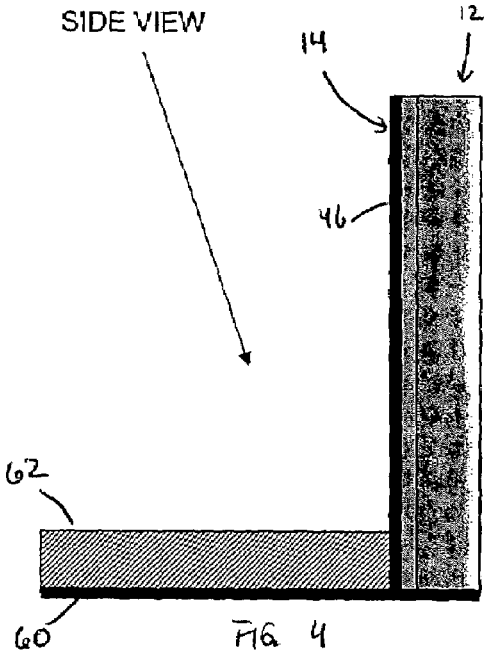
FIG. 4 is a side view of an alternative embodiment of the display system.
Figure 5:
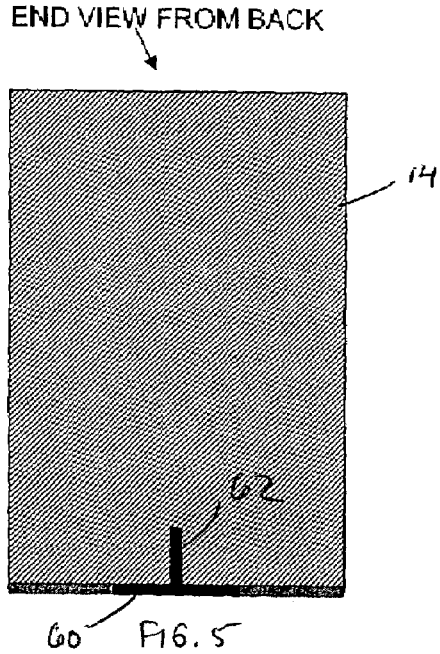
FIG. 5 is an end view from back of the alternative embodiment of the display system of FIG. 4.
Figure 6:
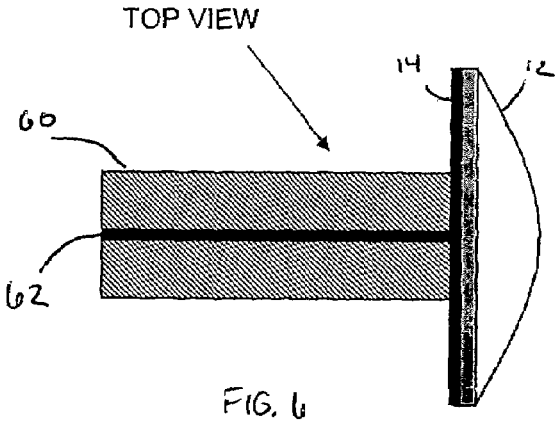
FIG. 6 is a top view of the alternative embodiment of the display system of FIG. 4.

Referring to FIGS. 4-6, there is shown an alternative embodiment of the mounting plate 14. In this embodiment, the mounting plate 14 includes a rearward projecting plate 60 with an upward projecting rib 62 extending down the center of the rearward projecting plate 60. In this embodiment, the rearward projecting plate 60 is designed to be slid under the bases of two back to back gaming or vending machines that are on the end of a bank of machines with the upward projecting rib 62 between the two machines. This embodiment is beneficial when there is not enough room at the end of a cabinet base to mount the display system 10 using the anchor holes 52.

In use, the benefits and advantages of the display system 10 of the present invention become apparent. The easy access provided by the clamp frame assemblies and hinged top allow immediate access for loading and unloading graphics. Moreover, the face sheet can be removed in a matter of seconds for service of the fluorescent bulbs or other internal components.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A display system for gaming cabinets comprising:

a backlit display comprising:

an arcuate translucent face sheet;

a support frame for supporting a lighting source and said face sheet, said support frame comprising a top cover, a base member, and an opposing pair of side clamp frame assemblies;

wherein said pair of side clamp frame assemblies each comprise:

a clamp base member for retaining an edge of said arcuate face sheet;

a sheet clamp pivotally attached to said clamp base; and an over-center spring for biasing said sheet clamp into either an open position or a closed position; and a mounting plate comprising:

a back panel for fixing to a back side of said backlit display;

a base plate including a plurality of anchor holes for securing said display system to a rigid support surface.

2. The display system of claim 1, wherein said side clamp frame assemblies are formed of an extruded metal.

3. The display system of claim 2, wherein said side clamp frame assemblies are formed of an extruded aluminum.

4. The display system of claim 1, wherein said top cover is hinged.

5. The display system of claim 1, wherein said arcute translucent face sheet is formed of plastic.

6. The display system of claim 5, wherein said arcuate translucent face sheet is formed of a white arcrylic.

7. The display system of claim 1, wherein said mounting plate is formed of 18 ga. steel.

* * * * *